US005351825A

United States Patent [19]

Duffy

[11] Patent Number: 5,351,825

[45] Date of Patent: Oct. 4, 1994

[54] PACKAGING PLUG WITH CONICAL NOSE

[75] Inventor: Thomas J. Duffy, Appleton, Wis.

[73] Assignee: Badger Plug Company, Appleton, Wis.

[21] Appl. No.: 999,595

[22] Filed: Dec. 31, 1992

[51] Int. Cl.[5] ..... B65D 85/672

[52] U.S. Cl. ..... 206/394; 206/413

[58] Field of Search ..... 206/225, 389, 391, 392, 206/394, 397, 407, 408, 411, 413–416, 588, 589, 493

[56] References Cited

U.S. PATENT DOCUMENTS

| | | | |
|---|---|---|---|
| 2,610,735 | 9/1952 | Ferguson | 206/392 |
| 2,646,166 | 7/1953 | Paffen et al. | 206/392 |
| 3,371,776 | 3/1968 | Voissem | 206/394 |
| 3,375,919 | 4/1968 | Schlager et al. | 206/392 |
| 4,482,051 | 11/1984 | Cantey, Jr. | 206/392 |
| 4,690,345 | 9/1987 | Cotey | 206/416 |
| 4,826,008 | 5/1989 | Cloosterman | 206/415 |
| 4,903,833 | 2/1990 | Beery | 206/416 |
| 5,100,075 | 3/1992 | Morand | 206/394 |

OTHER PUBLICATIONS

Brochure, Badger Plug Co., one page, showing prior art, no date.

Photograph of five plugs showing prior art, no date.

*Primary Examiner*—Jimmy G. Foster

*Attorney, Agent, or Firm*—Donald S. Dowden

[57] ABSTRACT

A plug is provided for use in packaging roll goods rolled about a hollow, substantially cylindrical core. The plug is adapted for coupling with the core to assist in fixing the position of the roll goods. The plug comprises a cylindrical portion designed to fit within the core with a small clearance so that the axes of the core and the plug are substantially coincident with each other. A flange extends from the cylindrical portion and is engageable with an axial end of the roll goods to limit relative axial movement of the plug and the roll goods with respect to each other. A nose extends axially from the substantially cylindrical portion in spaced-apart relation to the flange. The nose is substantially conical, has a base diameter substantially equal to the diameter of the cylindrical portion, and tapers to a vertex spaced apart from the cylindrical portion. This facilitates blind coupling of the plug and the core even if the plug and the roll goods when making initial contact with each other are laterally offset from each other by a distance up to a half of the diameter of the core.

7 Claims, 3 Drawing Sheets

PACKAGING PLUG WITH CONICAL NOSE

BACKGROUND OF THE INVENTION

Field of the Invention

This invention relates to plugs for use in packaging roll goods and in particular to a novel and highly effective plug that facilitates "blind" coupling of the plug with the core of the roll goods even if the plug and the roll goods when making initial contact with each other are laterally offset from each other by a distance of up to a half of the diameter of the core.

Description of the Prior Art

So-called roll goods of paper, steel and other basic materials required by industry in large quantities are rolled about a hollow, substantially cylindrical core. Depending on the goods, the core may be formed of cardboard, plastic, metal or some other material or may be formed by the innermost convolution of the paper, steel, etc., itself.

In packaging roll goods for shipment, warehouse handling, storage, etc., it is conventional practice to stack them on a pallet. For example, a pallet may be provided to accommodate a 3×3×3 array of 27 rolls each arranged with its axis extending vertically. That is, there are three tiers of nine rolls each, each tier has three rows of rolls, and each row has three rolls.

In order to position the rolls accurately, plugs are often employed for coupling with the roll cores, and separation sheets separate the tiers.

For example, so-called single plugs arranged in a 3×3 array are placed on the pallet in positions that are approximately correct to receive the rolls in a compact 3×3 array, and a separation sheet with a 3×3 array of preformed holes is placed over the array of plugs so that the plugs extend through the respective holes. The plugs have a core-insertion piece and a radial flange. Since the holes in the separation sheet are die-cut and accurately positioned, placing the separation sheet over the plugs accurately positions the plugs.

Then the cores of a 3×3 array of rolls forming the first tier are respectively placed over the portions of the plugs that protrude through the holes. Since the plugs are accurately positioned, so are the rolls.

Then so-called double plugs arranged in a 3×3 array are respectively placed in the opposite ends of the array of cores. Each double plug has a flange that engages a roll and prevents the plug from falling into the core, and a core-insertion piece that extends out from each side of the flange. Thus the double plugs arranged in a 3×3 array are positioned so that their core-insertion pieces on the sides of their respective flanges opposite the core-insertion pieces that extend into the respective cores of the first tier of rolls can receive a second separation sheet followed by a second tier of rolls in a 3×3 array.

This process is repeated until the final tier of roles is in place, and then a final separation sheet is positioned and single plugs forming another 3×3 array are inserted through the holes of the final separation sheet and into the respective cores of the top tier of rolls to form a very compact, generally cubic structure that is easily and efficiently handled, shipped and stored.

In the example, a 3×3×3 cubic structure is described. Of course, as those skilled in the art will readily understand, the arrangement need not be a 3×3×3 array but can be any other array that is convenient for handling, shipping and storage. Also, the pallet can be of any conventional or unconventional construction and can be made of plastic, wood, metal, or another suitable material.

A problem in using conventional plugs is that the rolls, which may be heavy and of large diameter, must be loaded onto the plugs "blind"; that is, when a roll is placed over a plug in order to be lowered onto the plug, the laborer (if the loading is done manually) or operator of the loading equipment (if loading equipment is used) cannot see the plug or cannot see it very well. It often happens that, when the plug and the roll make initial contact with each other, they are laterally offset form each other so that the plug does not enter the role core. The laborer or operator must then "feel around" to find the correct loading position. If he misses the mark the roll may be damaged. The same problem arises if programmed robots are employed to load the rolls, unless (or even if) the robots get feedback from precise sensors and a sophisticated servo loop, which comes at a cost that may be prohibitive, especially in a small facility.

Various attempts have been made to address the problems outlined above. In particular, Badger Plug Company of Appleton, Wisconsin, and other companies have designed plugs with varying degrees of "radiusing" at the top to facilitate easier plug insertion. However, even the best of the designs made heretofore have failed to provide an adequate solution to the problem.

OBJECTS AND SUMMARY OF THE INVENTION

An object of the invention is to solve the problems of the prior art and in particular to provide a plug for use in packaging roll goods that facilitates blind coupling of the plug with the core of the roll goods even if the plug and the roll goods when making initial contact with each other are laterally offset from each other by a distance of up to a half of the diameter of the core.

Another object of the invention is to provide a plug for use in packaging roll goods that improves the ease and efficiency with which roll goods can be packaged.

The foregoing and other objects are attained in accordance with the invention by the provision of a plug for use in packaging roll goods rolled about a hollow, substantially cylindrical core, the plug being adapted for coupling with the core to assist in fixing the position of the roll goods and comprising a substantially cylindrical portion designed to fit within the core with a small clearance so that the axes of the core and the plug are substantially coincident with each other. Flange means extends radially from the cylindrical portion and is engageable with an axial end of the roll goods to limit relative axial movement of the plug and the roll goods with respect to each other. A nose extends axially from the substantially cylindrical portion in spaced-apart relation to the flange means. The nose is substantially conical and has a base diameter substantially equal to the diameter of the substantially cylindrical portion. The nose tapers to a vertex spaced apart from the substantially cylindrical portion. This construction facilitates blind coupling of the plug and the core even if the plug and the roll goods when making initial contact with each other are laterally offset from each other by a distance of up to a half of the diameter of the core.

BRIEF DESCRIPTION OF THE DRAWING

A better understanding of the objects, features and advantages of the invention can be gained from a consideration of the following detailed description of the preferred embodiments thereof, in conjunction with the appended figures of the drawing, wherein.

DESCRIPTION OF THE PREFERRED EMBODIMENTS

Figure 1:
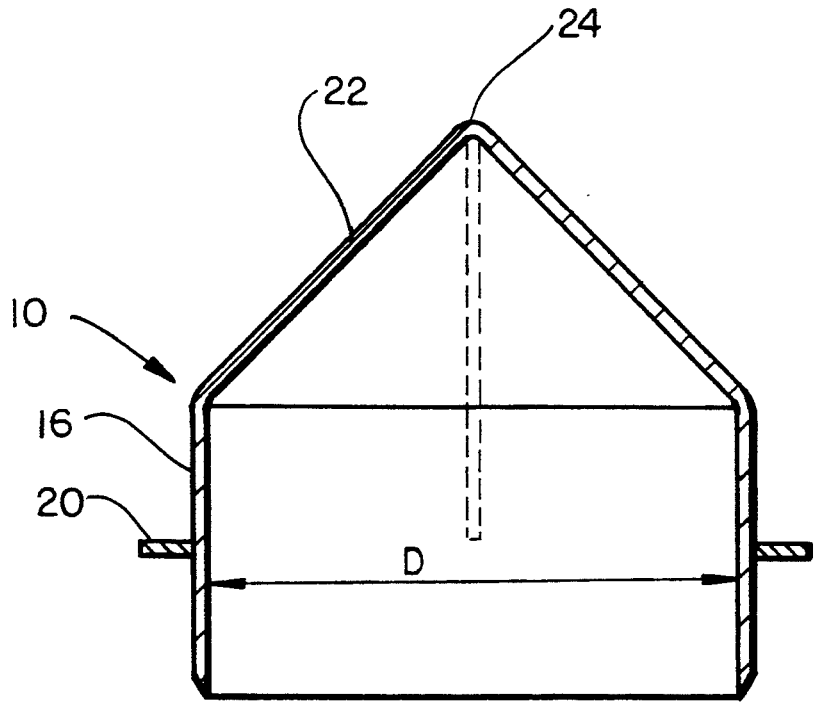
FIG. 1 is a axial sectional view of a double plug constructed in accordance with the invention.

FIG. 1 shows a double plug 10 constructed in accordance with the invention. The plug is adapted for use in packaging roll goods such as 12 (FIGS. 2 and 3) rolled about a hollow, substantially cylindrical core 14 (best shown in FIG. 2). The core is usually hollow along its entire length but need be hollow only at its ends. The plug 10 and any of the cores 14 are adapted to be coupled with each other as shown for example in FIGS. 2 and 3 to assist in fixing the position of the roll goods.

Figure 2:
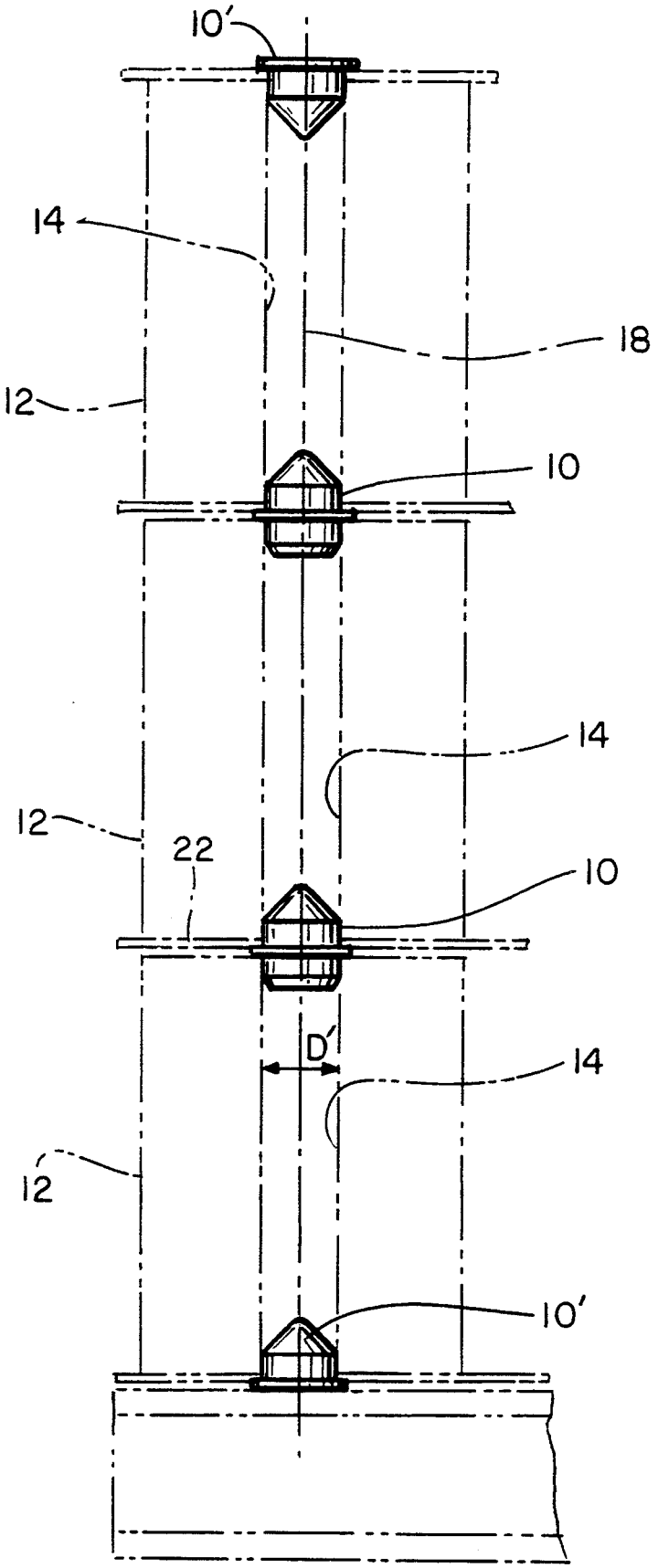
FIG. 2 is a fragmentary elevational view, partly in phantom, showing single and double plugs employed in accordance with the invention for stacking three rolls on a pallet.
Figure 3:
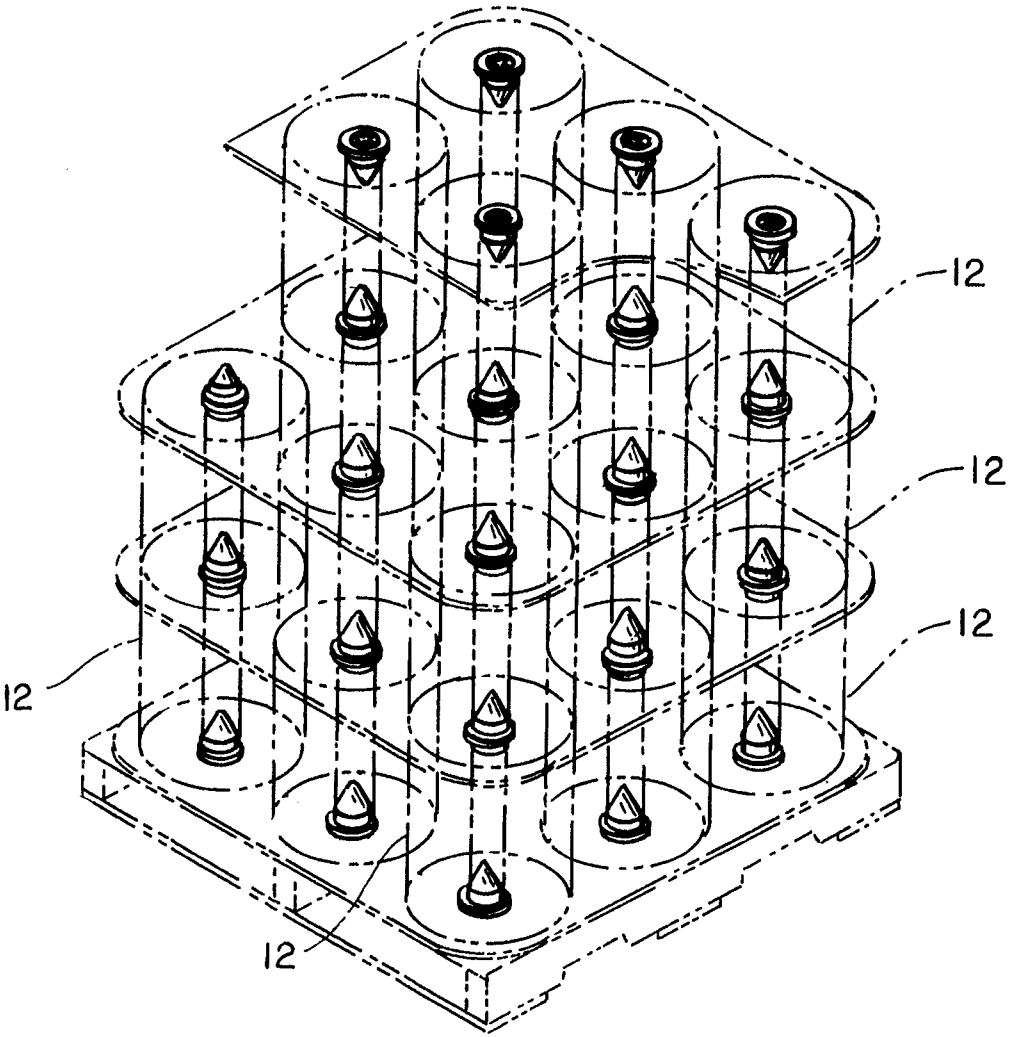
FIG. 3 is a perspective view, partly in phantom and partly broken away, showing a 3×3×3 array of rolls stacked on a pallet and employing single and double plugs in accordance with the invention.

The plug 10 comprises a substantially cylindrical portion 16 designed to fit within the core 14 with a small clearance so that the axes of the plug 10 and core 14 are substantially coincident with each other along a line 18, as FIG. 2 best illustrates.

A flange 20 extends from the central portion 16 in a radial direction and is engageable with an axial end 22 (FIG. 2) of the roll goods 12 to limit relative axial movement of the plug 10 and the roll goods 12 with respect to each other.

A nose 22 extends axially from the cylindrical portion 16 in spaced-apart relation to the flange 20. The nose is substantially conical, and it has a base diameter D substantially equal to the diameter of the cylindrical portion 16, as FIG. 1 best illustrates. The nose 22 tapers to a vertex 24 spaced apart from the cylindrical portion 16.

This structure facilitates blind coupling of the plug 10 and the core 14 even if the plug 10 and the roll 12 when making initial contact with each other are laterally offset from each other by a distance of up to a half of the diameter D′ of the core (FIG. 2). The diameter D is nearly the same as the diameter D′.

The nose 22 is preferably formed as a right circular cone with a half-angle of about 45°, although other conical constructions are within the scope of the invention. For example, the cone can depart from a strict conical shape by being slightly convex or concave, or it can be formed with perforations or of a mesh work or lattice or of separate legs extending from the base of the cone to the vertex of the cone. Also, the vertex can be slightly rounded for safety in use and ease in manufacturing.

The cylindrical portion 16 of the plug 10 is preferably formed as an unbroken surface, but it can be formed as a mesh work or lattice, of a plurality of discs or rings axially spaced apart from one another and connected by a supporting structure, etc.

The flange 20 is preferably formed as a one-piece ring extending radially from the cylindrical portion 16. However, it can be formed as separate tabs or flanges spaced circumferentially around the cylindrical portion 16.

As FIG. 1 shows, the cylindrical portion 16 extends axially in opposite directions from the flange 20, so that the plug can be separately coupled with a core of roll goods at a location 26 on a side of the flange 20 opposite the nose 22. A single core has the same structure as that shown in FIG. 1 except that the portion below the flange 20 is omitted. See for example the single cores 10′0 in FIG. 2.

The cores are preferably made of plastic for most uses but can be made of metal, wood, or any other suitable material.

Thus there is provided in accordance with the invention a novel and highly effective plug for use in packaging roll goods. The plug attains the objects of the invention set out above and is constructed so that, even if the plug and the roll goods when making initial contact with each other are laterally offset from each other by a distance of up to a half of the diameter of the core, the plug and the core are easily coupled together.

When the nose 22 engages the core, as long as the vertex 24 is able to enter the core, the nose 22 will act as a cam surface which guides the plug and core into a coupled relation.

Many modifications of the preferred embodiments of the plug disclosed above will readily occur to those skilled in the art. Accordingly, the invention is to be construed as including all structure that falls within the scope of the appended claims.

I claim:

1. In combination: (a) first lower roll goods rolled about a first hollow, substantially cylindrical, vertically extending core, (b) second upper roll goods rolled about a second hollow, substantially cylindrical, vertically extending core, and (c) a plug coupled between the two cores to assist in fixing the position of the second roll goods above the first roll goods, said plug comprising:

a substantially cylindrical portion designed to fit within the first and second cores with a small clearance so that the axes of the cores and the plug are substantially coincident with each other;

flange means extending radially out from the substantially cylindrical portion of the plug far enough to engage an axial end of at least the first roll goods to limit relative axial movement of the plug and the first roll goods with respect to each other, the substantially cylindrically portion extending axially in opposite directions from the flange means; and a nose extending axially from the substantially cylindrical portion in spaced-apart relation to the flange means, the nose being substantially conical, having a base diameter substantially equal to the diameter of the substantially cylindrical portion, and tapering to a vertex spaced apart from the substantially cylindrical portion;

thereby having facilitated blind coupling of the plug and the second core even if the plug and the second roll goods when making initial contact with each other were laterally offset from each other by a distance of up to a half of the diameter of the core.

2. A combination according to claim 1 wherein the substantially cylindrical portion is formed as an unbroken surface.

3. A combination according to claim 1 wherein the flange means is formed as a one-piece ring extending radially from the substantially cylindrical portion.

4. A combination according to claim 1 wherein the nose is formed as a right circular cone.

5. A combination according to claim 1 wherein the plug is made of plastic.

6. A combination according to claim 1 wherein the plug is made of metal.

7. A combination according to claim 1 wherein the plug is made of wood.

* * * * *